United States Patent [19]

Uppstrom

[11] Patent Number: 5,001,863

[45] Date of Patent: Mar. 26, 1991

[54] HINGE SYSTEM

[76] Inventor: Russell E. Uppstrom, 17 Woodlawn St., Northboro, Mass. 01532

[21] Appl. No.: 403,582

[22] Filed: Sep. 6, 1989

Related U.S. Application Data

[60] Division of Ser. No. 281,091, Dec. 7, 1988, now U.S. Pat. No. 4,882,809, which is a continuation of Ser. No. 52,533, May 20, 1987, now abandoned.

[51] Int. Cl.[5] ..... E05D 7/00; E05D 5/00

[52] U.S. Cl. ..... 49/399; 16/384

[58] Field of Search ..... 16/382, 384; 49/381, 49/399

[56] References Cited

U.S. PATENT DOCUMENTS

| | | | |
|---|---|---|---|
| 144,898 | 11/1873 | Gathmann | 16/268 |
| 440,320 | 11/1890 | Macy | 16/288 |
| 442,093 | 12/1890 | Bates | 16/128 |
| 537,697 | 4/1895 | Meriwether | 16/248 |
| 677,637 | 7/1901 | Casey | 16/384 |
| 778,144 | 12/1904 | Poole | 16/384 |
| 1,142,167 | 8/1915 | Hayes | 16/384 |
| 1,170,106 | 2/1916 | Rockwell | 16/268 |
| 1,316,417 | 4/1919 | Rockwell | 16/268 |
| 1,341,690 | 6/1920 | Werner | 16/268 |
| 3,349,428 | 10/1967 | Suska | 16/128 |
| 3,349,429 | 10/1967 | Suska | 16/128 |
| 3,662,493 | 5/1972 | Foltz | 49/388 |

FOREIGN PATENT DOCUMENTS

| | | | |
|---|---|---|---|
| 32594 | 4/1908 | Austria | 16/384 |
| 69047 | 1/1957 | Fed. Rep. of Germany | 16/384 |
| 2313293 | 9/1974 | Fed. Rep. of Germany | 16/384 |
| 513143 | 2/1921 | France | 16/384 |
| 265145 | 2/1950 | Switzerland | 16/384 |
| 1180830 | 2/1970 | United Kingdom | 16/384 |

*Primary Examiner*—Richard K. Seidel
*Assistant Examiner*—Carmine Cuda
*Attorney, Agent, or Firm*—Blodgett & Blodgett

[57] ABSTRACT

A hinge system including a door and a frame having matching angular edge surfaces and a hinge comprising an L-shaped pintle and an elongated secondary element each having a wood screw thread wherein the pintle has a vertical leg and the secondary element has a bore fitting snugly over the vertical leg and each wood screw thread is secured in a respective angular surface at a right angle thereto.

3 Claims, 1 Drawing Sheet

HINGE SYSTEM

This is a divisional of copending application Ser. No. 07/281,091 filed on 12/7/88, now U.S. Pat. No. 4,882,809, which is a continuation of Ser. No. 052,533 filed May 20, 1987 now abandoned.

BACKGROUND OF THE INVENTION

There are many situations, particularly in house building, in which it is desirable to mount a swingable element such as a cabinet door or a window shutter, for movement about a vertical hinge axis. In most cases, a mortising operation is necessary in order to screw a hinge or a butt in place. When this has been done, it is very difficult to make any adjustments, so that, if a slight inaccuracy is present, the door will not swing and fit properly in its opening. In a similar way, when attaching a shutter to the side of a window, there is no simple way of adjusting the shutter so it fits exactly and properly beside the window. Attempts to provide for adjustment in a hinge have been attempted over the years and in many cases the results have been quite complicated and expensive. Furthermore, such devices have been easily rendered inoperative by the effects of weather deterioration or accidental bending and the like. These and other difficulties experienced with the prior art devices have been obviated in a novel manner by the present invention.

It is, therefore, an outstanding object of the invention to provide a hinge that is intended especially for cabinet doors and window shutters and in which adjustments of the axis are readily accomplished.

Another object of this invention is the provision of a hinge which is simple in construction, which is inexpensive to manufacture and which is capable of a long life of useful service with a minimum of maintenance.

A further object of the present invention is the provision of a hinge particularly for use in mounting swingable wooden structures and in which the location of the structure is readily accomplished without mortising, but which has sufficient adjustment to produce accurate placement.

It is another object of the instant invention to provide a hinge which is pleasant in appearance and which is capable of small amounts of adjustment to accurately locate swingable elements.

SUMMARY OF THE INVENTION

In general, the invention consists of a hinge provided with an L-shaped pintle which has a horizontal leg formed with a wood screw thread adapted to be secured in a fixed structure and which has a vertical leg. An elongated secondary element having a wood screw thread at one end is adapted to be secured in a swingable structure and has a bore adjacent to the other end that fits snugly over the vertical leg of the pintle.

More specifically, the pintle is threaded and carries a nut with a set screw, the secondary element resting on the nut in an adjustable vertical position. The vertical leg of the pintle has an upper portion of reduced diameter and the bore in the secondary element has a diameter somewhat greater than that of the said upper portion of the vertical leg of the pintle.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
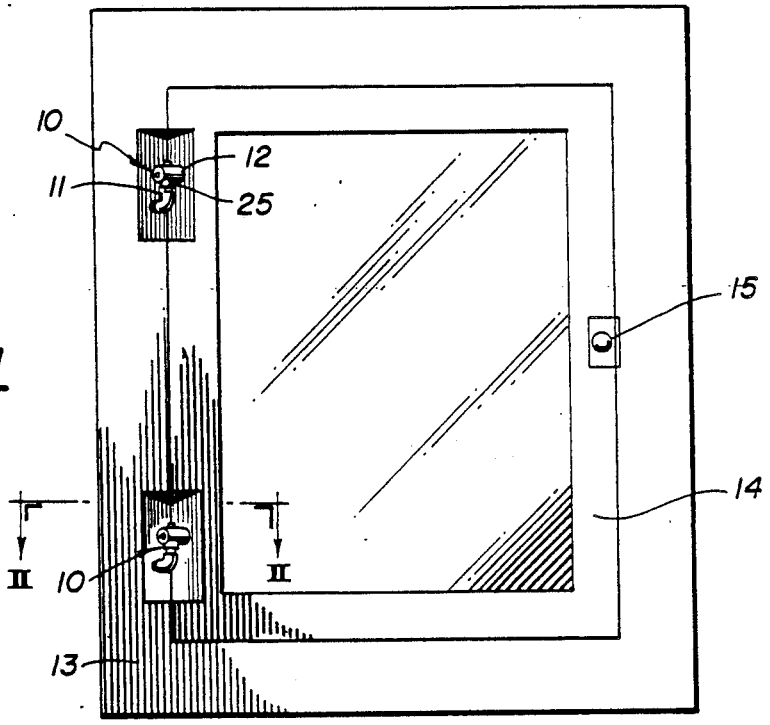
FIG. 1 is a front elevational view of a hinge incorporating the principles of the present invention, hinge being shown in use for mounting a cabinet door in a cabinet frame.
Figure 2:
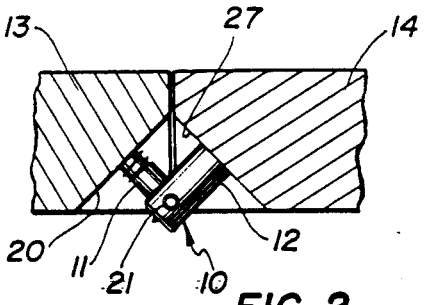
FIG. 2 is a horizontal sectional view of the invention taken on the line II—II of FIG. 1.

Referring first to FIGS. 1 and 2, which best shows the general features of the invention, the hinge, indicated generally by the reference numeral 10, is shown as mounting a swingable structure, such as a cabinet door 14, in a fixed structure, such as a cabinet frame 13. Two of the hinges 10 are used along one edge of the door and a latch 15 is applied to the other edge. The hinge 10 consists of a pintle 11, a secondary element 12, and a nut 25.

Figure 3:
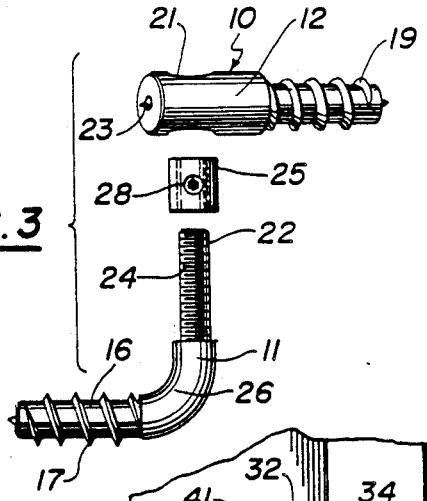
FIG. 3 is an exploded perspective view of the invention.

As is evident in FIG. 3, the pintle 11 is L-shaped and has a horizontal leg 16 formed with a wood-screw thread 17 that is adapted to be secured in the fixed structure or frame 13. The pintle also has a vertical leg. The secondary element 12 is straight and elongated; it has a wood-screw thread 19 at one end which is adapted to be secured in the swingable structure such as the cabinet door 14. The secondary element has a bore 21 adjacent the other end which bore fits snugly over the vertical leg of the pintle.

The vertical leg of the pintle has an upper portion 22 of reduced diameter and the bore 21 in the secondary element 12 has a diameter somewhat greater than that of the said upper portion. The said other end of the secondary element 12 is provided with a scribing protuberance 23 that is formed on and extends coaxially thereof.

As is evident in FIG. 3, a transition portion 26 is provided that extends between the horizontal leg 16 and the vertical leg. In the preferred embodiment, the pintle and secondary element are each formed from a rod of a copper-base alloy, such as brass.

The upper portion 22 of the vertical leg of the pintle is provided with threads 24 and carries a nut 25 on which the secondary element 12 rests in an adjustable vertical position, the nut being locked in position by a socket-head set screw 28.

The operation of the invention will now be readily understood in view of the above description. When the cabinet door 14 is to be mounted in its frame 13, it is a practice, according to the present invention, to provide the adjacent corners of these elements with 45 degree bevels 20 and 27, as shown in FIG. 2. A hole is bored perpendicular to the bevel 20 and the pintle 11 is screwed into the bore in the frame 13 taking advantage of the wood screw threads 17. It is left with its vertical leg extending in a vertical position. Similarly, a bore is provided in the 45 degree bevel 27 on the door 14 and the secondary element 12 is screwed into that bore making use of the wood screw threads 19. It is possible (by adjusting the amount that one screws the pintle 11 and the secondary element 12 into their respective frames 13 and doors 14) to adjust the swing axis in accordance with the optimum fitting of the door within the frame. Once the secondary element 12 has been provided on the door, the door is then lowered, so that the upper portion 22 of the vertical leg of the pintle rests within the bore 21. The nut 25 has been previously threaded onto the upper portion 22 and it is then possible by actuating the nut 25 to determine the height that the door rests on the pintle.

As shown in FIG. 1, it is normal practice to use two such hinges and to adjust the two nuts that are provided with the hinges approximately to allow the door to rest with equal weight on each pintle. If it is found that the door does not fit exactly correctly, it is possible, by manipulating the two parts of the hinge, namely, the pintle 11 and the secondary element 12 to make suitable adjustments. Screwing the pintle 11 in and out of the bore in the frame 13 causes the vertical axis to move not only laterally but also in the direction at a right angle to the surface of the door and the frame. A similar rotation of the secondary element 12 can cause the bore 21 to reside at various distances relative to the door and frame relationship. Furthermore, since there are two hinges, a slight angularity in the door can be accomplished simply by tilting the pintles 11 to cause the hinge axis to move at an angle. It is, therefore, possible by suitable manipulation of the parts to cause the hinge axis to be in any location that is desirable to cause the door 14 to fit perfectly into the opening in the cabinet frame 13.

It can be seen that the use of a hinge in this way provides a simple, economical way of fitting cabinets and other similar doors in place with sufficient adjustment available to accomplish all types of alignment that is necessary or desirable. This can be accomplished without the necessity of cutting mortises in the doors and frames.

Figure 4:
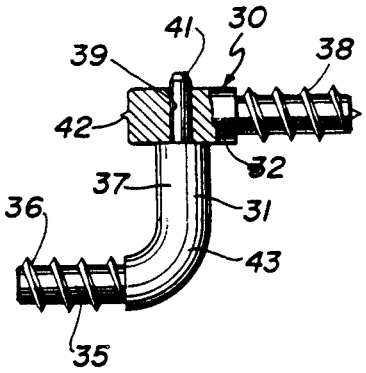
FIG. 4 is a front elevational view with portions in section of a modified form of the invention.
Figure 5:
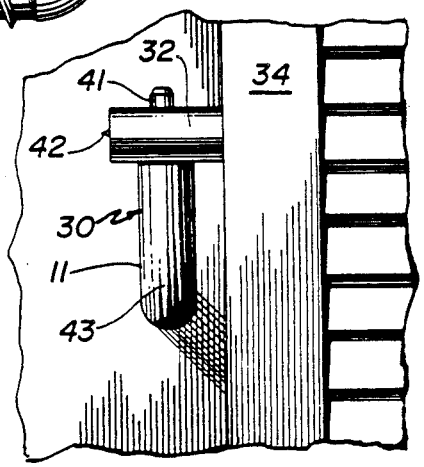
FIG. 5 is a front elevational view showing the hinge of FIG. 4 in use in mounting a window shutter on a house.

Referring to FIGS. 4 and 5, a simplified form of the hinge 30 is shown that can be used particularly in exterior applications where a great deal of accuracy is not desired or necessary. In providing for the mounting of window shutters, the adjustments that are available in the pintle 31 and the secondary element 32 are sufficient for that application. The pintle 31 is provided with a horizontal leg 35 which is provided with wood screw threads 36. The secondary element 32 is elongated and provided at one end with wood screw threads 38. The upper leg 37 of the pintle is provided with a reduced upper portion 41 which fits in a bore 39 in the secondary element 32. Furthermore, the secondary element 32 is provided with a scribing protuberance 42 for marking location. The bore 39 and the secondary element 32 fit snugly over the upper portion 41 of the vertical leg 37 of the pintle. A transition portion 43 extends between the horizontal and vertical parts of the pintle. The protuberance 42 can be used to mark a suitable location on the shutter 34 by placing the secondary element 32 over the pintle 31 and swinging it around toward the desired location of the shutter 34. The shutter is laid in desired location over the surface of the house 33 and the secondary element is swung around the upper portion 41 of the pintle until the protuberance 42 makes a scratch on the face of the shutter. This gives the location of the bore that is to be made in the shutter to receive the end of the secondary element 32 and the wood screw threads 38. The protuberance 23, incidentally, on the secondary element 12 of the hinge 10 can be used in a similar way to mark the location of the secondary element bore on the door 14 in case of the hinge 10.

Since the hinge is made entirely of a non-corrosive substance, such as copper or bronze, the location in the exterior of the house provides no deterioration problems and it is capable of a long life of service.

It is obvious that minor changes may be made in the form and construction of the invention without departing from the material spirit thereof. It is not, however, desired to confine the invention to the exact form herein shown and described, but is desired to include all such as properly come within the scope claimed.

The invention having been thus described, what is claimed as new and desired to secure by Letters Patent is:

1. Hinge system, comprising:

(a) a frame having a rectangular opening, (b) a door fitting in the frame and having a vertical edge surface lying against a similar vertical edge surface of the frame, wherein the door and frame have matching recesses entering on their said edge surfaces, each recess defining an angular surface extending at 45° to its corresponding edge surface, and (c) a hinge means extending between the angular surfaces to provide a hinge axis located on the plane defined by front face surfaces of the frame and door, the hinge means comprising an L-shaped pintle having a horizontal leg formed with a wood screw thread secured in the frame at a right angle to one of its angular surfaces and having an integral vertical leg, and an elongated secondary element having a wood screw thread at one end secured in the other of the said angular surfaces at a right angle thereto and having a cylindrical bore adjacent the other end, the bore extending completely through the element and fitting snugly over the said vertical leg of the pintle, the said vertical leg of the pintle having an upper portion of reduced diameter and the bore in the secondary element having a diameter somewhat greater than that of the said upper portion of the vertical leg of the pintle.

2. Hinge system as recited in claim 1, wherein the upper portion of the vertical leg of the pintle is threaded and carries a nut on which the secondary element rests in an adjustable vertical position.

3. Hinge as recited in claim 1, wherein a curved transition portion extends between the horizontal leg and the vertical leg of the pintle, and wherein the pintle and secondary element are formed from a rod of copper-based alloy.

* * * * *